United States Patent [19]

Darda

[11] Patent Number: 4,521,007

[45] Date of Patent: Jun. 4, 1985

[54] BRAKING BRUSHES IN FOLDING APPARATUS OF ROTARY PRINTING MACHINES

[75] Inventor: Walter Darda, Eppelheim, Fed. Rep. of Germany

[73] Assignee: Heidelberger Druckmaschinen AG, Heidelberg, Fed. Rep. of Germany

[21] Appl. No.: 620,859

[22] Filed: Jun. 15, 1984

[30] Foreign Application Priority Data

Jun. 15, 1983 [DE] Fed. Rep. of Germany ..... 3321577

[51] Int. Cl.[3] ..... B42C 1/04; B65H 23/08

[52] U.S. Cl. ..... 270/47; 400/613.3; 400/618; 226/195

[58] Field of Search ..... 270/47, 60; 400/613.3, 400/618; 226/195; 493/406; 271/182; 101/225, 228

[56] References Cited

U.S. PATENT DOCUMENTS

| | | | |
|---|---|---|---|
| 1,632,885 | 6/1927 | Colbert et al. | 226/195 X |
| 2,660,218 | 11/1953 | Johnson et al. | 226/195 X |
| 2,664,988 | 1/1954 | Metzner | 400/618 |
| 3,630,426 | 12/1971 | Rieger | 226/195 X |
| 3,846,021 | 11/1974 | Vola | 226/195 |
| 4,095,731 | 6/1978 | Harding et al. | 226/195 X |

FOREIGN PATENT DOCUMENTS

| | | | |
|---|---|---|---|
| 2142902 | 3/1973 | Fed. Rep. of Germany | 270/47 |
| 988728 | 1/1983 | U.S.S.R. | 226/195 |

*Primary Examiner*—E. H. Eickholt

*Attorney, Agent, or Firm*—Herbert L. Lerner; Laurence A. Greenberg

[57] ABSTRACT

Braking-brush assembly in folding apparatus of a rotary printing machine having braking brushes for stretching web sections which are being conveyed in a given direction on a folding cylinder of the folding apparatus, the braking brushes individually being disposed so as to match the curvature of the cylinder and being distributed over the length of the cylinder, including a spindle and a cross bar both spaced from one another and extending transversely to the given direction in which the web sections are being conveyed, the braking brushes being articulatingly fastened at lower ends thereof to the spindle and at upper ends thereof to the cross bar, and respective levers supporting the cross bar at each end thereof, the cross bar being independently adjustable by the respective levers for pressing the braking brushes to a greater and lesser extent selectively against the web sections being conveyed on the cylinder.

5 Claims, 3 Drawing Figures

BRAKING BRUSHES IN FOLDING APPARATUS OF ROTARY PRINTING MACHINES

The present invention relates to braking brushes arranged in folding apparatus of rotary printing machines for stretching web sections which are being conveyed on folding-apparatus cylinders, the individual braking brushes being matched to the diameter of the respective cylinder and, being distributed over the length of the respective cylinder.

Such brushes are already known to those operating in the field of folding apparatus; they are used to lay the sheets to be conveyed on the surface areas of the cylinder in order to ensure trouble-free transport or conveyance even when the machine is operating at slow speed. In addition, the sheets should always engage the cylinder surface area smoothly and without forming any waves or undulations, so that no folding differences can occur during subsequent operations, for example, when folding. Moreover, this specific arrangement of the brushes markedly prevents so-called edging or edge formation wherein due to the high speed prevailing at the following sheet end, a whip effect is produced i.e. an edge of the sheet is snapped off. On the other hand, care must be taken not to press the braking brushes too forcibly against the web section disposed on the cylinder, as otherwise there would be a risk of smearing the printed image on the web section.

It is accordingly an object of the invention to arrange the braking brushes in such a way that they can be adjusted in order to be able to increase, to a greater or lesser extent, the braking effect of the brushes unilaterally, during the operation of the machine, so that the subsequent operating steps, such as the folding operation, can be precisely regulated, in order to improve the accuracy and quality thereof.

With the foregoing and other objects in view, there is provided, in accordance with the invention, a braking-brush assembly in folding apparatus of a rotary printing machine having braking brushes for stretching web sections which are being conveyed in a given direction on a folding cylinder of the folding apparatus, the braking brushes individually being disposed so as to match the curvature of the cylinder and being distributed over the length of the cylinder, including a spindle and a cross bar both spaced from one another and extending transversely to the given direction in which the web sections are being conveyed, the braking brushes being articulatingly fastened at lower ends thereof to the spindle and at upper ends thereof to the cross bar, and respective levers supporting the cross bar at each end thereof, the cross bar being independently adjustable by the respective levers for pressing the braking brushes to a greater and lesser extent selectively against the web sections being conveyed on the cylinder.

Owing to the favorable seating and setting possibilities of the braking brushes, the individual web sections can be braked unilaterally, to a greater or lesser extent, so that the stretching effect thereof is increased or decreased. The advantage of that measure is that, for example, during the subsequent folding step, especially when the material to be folded covers a small number of pages and the paper is thin, the fold or lap can be made to an accuracy of fractions of a millimeter, thus improving not only the exact location of the fold, as such but also the angular position thereof.

In accordance with another feature of the invention, there are provided side frames for the folding apparatus, pivot bearings adjustably mounted on the side frames so as to vary the spacing of the braking brushes with respect to the cylinder.

In accordance with a further feature of the invention, there are provided setscrews for adjustably mounting the pivot bearings on the side frames.

In accordance with an additional feature of the invention, there are provided spherical-disk ball-socket bearings for effecting the articulating fastening of the lower end of the braking brushes to the spindle, and spherical-disk bll-socket bearings for effecting the articulating fastening of the upper end of the braking brushes to the cross bar, cross bar being divided substantially into halves at the middle thereof in the given conveying direction of the web sections, levers, respectively, being disposed at both ends of each of cross-bar halves.

In accordance with a concomitant feature of the invention, there are provided adjusting spindles connected to the levers for adjusting the levers and the cross-bar halves.

By dividing the braking brush units into two segments which are separately adjustable over the length of the cylinder area, an adjustment or control is possible even when, over the length of the cylinder, two web sections are conveyed side by side and subsequently folded. This specific solution permits individual adjustment of each web section, thus adding to the folding quality thereof.

Other features which are considered as characteristic for the invention are set forth in the appended claims.

Although the invention is illustrated and described herein as embodied in braking brushes in folding apparatus of rotary printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
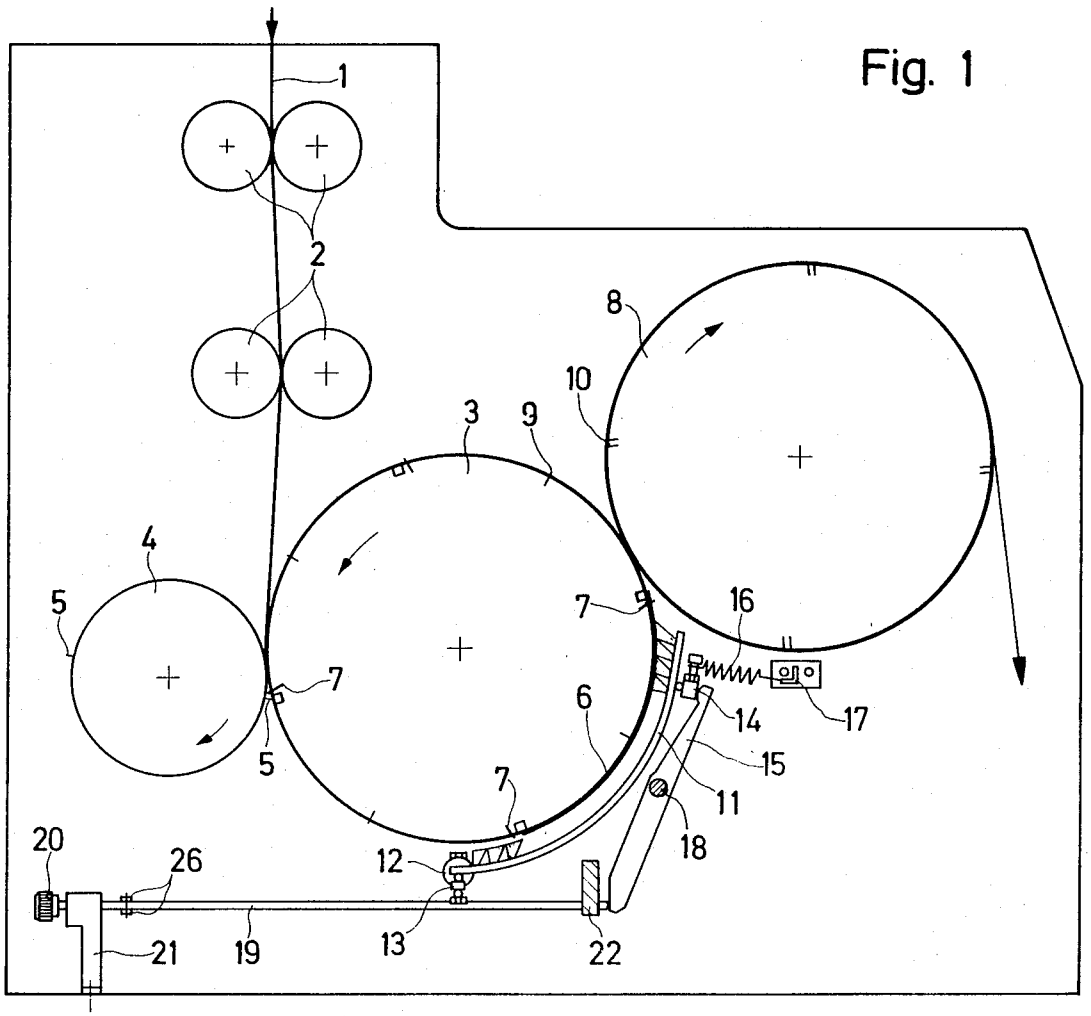
FIG. 1 is a diagrammatic side elevational view of a folding unit with braking brushes according to the invention.
Figure 2:
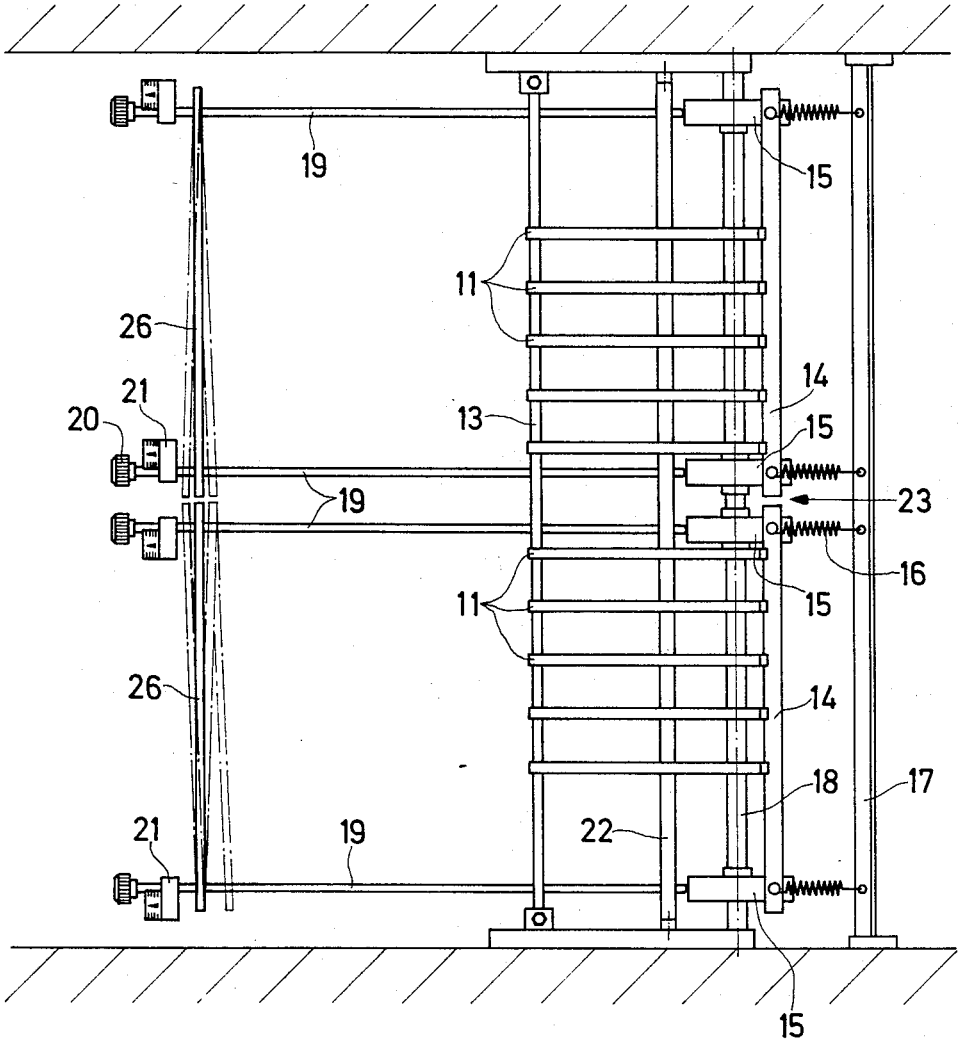
FIG. 2 is a top plan view of FIG. 1 with the rollers and cylinders removed.

Referring now to the drawing, the configuration of the folding apparatus as such, as shown in FIGS. 1 and 2 of the drawing, is already known. Thus, the paper web 1, which may have been folded lengthwise by a non-illustrated funnel, is fed towards a drawing roller group 2, from which it is conveyed to a puncturing or pointing and folding knife cylinder 3. The cylinder 3, in turn, cooperates with a cutting cylinder 4, having a cutting knife 5 which serves the paper web 1 into individual web sections 6. These web sections 6 are taken over by points 7, such as pins or needles, and, upon the further rotation of the puncturing and folding knife cylinder 3 beyond the center thereof, are advanced to the folding jaw or nip and tuck cylinder 8. Folding knives 9 and folding jaws 10 then produce the first quarter or cross fold between the two cylinders 3 and 8. The folded product is fed, thereafter, to a receiving unit.

In the illustrated embodiment, braking brushes 11 which match the curvature of the surface area of the puncturing and folding knife cylinder 3 are assigned thereto. Several braking brushes 11 are arranged across the width of the oncoming paper webs 1 and brake the web sections and consequently stretch them. At the lower end of the braking brushes 11, the latter are articulatingly fastened to a spindle 13 and, in the illustrated embodiment, at the upper end thereof, to a cross bar 14. The cross bar 14 rests at both ends thereof on a respective lever 15 and can be adjusted separately on both sides by each of the levers 15. In this way, the braking brushes 11 can be pressed to a greater or lesser extent against the web sections 6 lying on the cylinder 3. A tension spring 16 which is fastened to an angular bar element 17 assists or supports the contact of the cross bar 14 with the levers 15.

The levers 15 are pivotally mounted on a round cross bar 18 and are adjusted via adjusting spindles 19 and an adjusting wheel 20 on the side opposite that of the cross bar 14. The adjusting spindle 19 is rotatably mounted in a small stand or support 21 and in a rail 22, respectively. Both the small stand 21 and the adjusting spindle 19 in the vicinity of the small stand are formed with a thread, so that when the adjusting spindle 19 is turned or twisted, it executes a movement in longitudinal direction which is transmitted to the lever 15, and via the cross bar 14, the braking brushes 11 are pressed to a greater or lesser extent against the web sections 6 lying on the cylinder 3. At two double strips 26 which are fixed to the adjusting spindles 19 the relative position of the brushes on the cylinder 3 can be determined optically.

In the top plan view of FIG. 2, the arrangement of the braking of the braking brushes 11 across the width of the paper web 1 can be clearly seen. FIG. 2 also shows that the cross bar 14 is divided at the middle 23 thereof. This configuration permits the separate or individual adjustment, via the braking brushes 11, of two web sections 6 arranged side by side. When a cross bar 14 is divided, four of the levers 15 and the adjusting means thereof, respectively, have to be provided across the width of the machine. When the cross bar is undivided, only one lever 15 on each side is sufficient.

Figure 3:
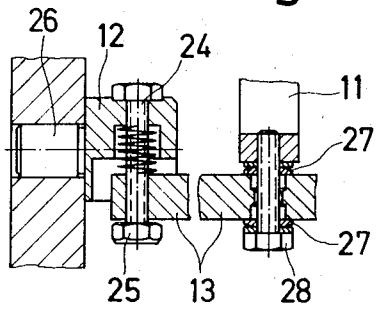
FIG. 3 is an enlarged fragmentary cross-sectional view of FIG. 1 showing a bearing of the spindles with the braking brushes.

In FIG. 3, two sectional views of the spindle 13 are presented the left-half of the figure showing the attachment of the spindle 13 by an adjusting screw or setscrew 24 at the articulating bearing 12. The lower extremity of the screw 24 is limited by a lock nut 25. By turning the adjusting screw 24, the spindle 13 is lifted to a greater or lesser extent so that the braking brushes 11 can be adjusted with respect to the cylinder surface area of the puncturing and folding knife cylinder 3. The articulating or pivot bearing 12 is thereby mounted, via a pivot or journal 26, on the lateral frames of the printing press.

The cross-sectional view at the right-hand side of FIG. 3 shows how the braking brush 11 is articulatingly fastened to the spindle 13. To this effect, two spherical-disk ball-socket bearings 27 are used on both sides of the spindle 13 and are retained by a screw 28. With the screw 28, the braking brush 11 is threadedly secured to the spindle 13 in such a way that a tilting movement is possible in either direction.

With this specific manner of mounting the braking brushes 11, the latter are able to be adjusted parallel and unilaterally with respect to the puncturing and folding knife cylinder 3. Via the adjusting wheel 20, an adjustment during the operating cycle of the machine is possible so that a sensitive optimization of the folding accuracy is possible even with varying numbers of pages and paper qualities.

There are claimed:

1. Braking-brush assembly in folding apparatus of a rotary printing machine having braking brushes for stretching web sections which are being conveyed in a given direction on a folding cylinder of the folding apparatus, the braking brushes individually being disposed so as to match the curvature of the cylinder and being distributed over the length of the cylinder, comprising a spindle and a cross bar both spaced from one another and extending transversely to the given direction in which the web sections are being conveyed, the braking brushes being articulatingly fastened at lower ends thereof to said spindle and at upper ends thereof to said cross bar, and respective levers supporting said cross bar at each end thereof, said cross bar being independently adjustable by the respective levers for pressing the braking brushes to a greater and lesser extent selectively against the web sections being conveyed on the cylinder.

2. Braking-brush assembly according to claim 1 including side frames for the folding apparatus, pivot bearings adjustably mounted on said side frames so as to vary the spacing of the braking brushes with respect to the cylinder.

3. Braking-brush assembly according to claim 2 including setscrews for adjustably mounting said pivot bearings on said side frames.

4. Braking-brush assembly according to claim 1 including spherical-disk ball-socket bearings for effecting the articulating fastening of said lower end of the braking brushes to said spindle, and spherical-disk ball-socket bearings for effecting the articulating fastening of said upper end of the braking brushes to said cross bar, said cross bar being divided substantially into halves at the middle thereof in the given conveying direction of the web sections, said levers, respectively, being disposed at both ends of each of said cross-bar halves.

5. Braking-brush assembly according to claim 4 including adjusting spindles connected to said levers for adjusting said levers and said cross-bar halves.

* * * * *